US010288288B2

(12) United States Patent
Yang

(10) Patent No.: US 10,288,288 B2
(45) Date of Patent: May 14, 2019

(54) GAS HEATING DEVICE

(71) Applicant: Pro-Iroda Industries, Inc., Taichung (TW)

(72) Inventor: Cheng-Nan Yang, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 143 days.

(21) Appl. No.: 15/361,557

(22) Filed: Nov. 28, 2016

(65) Prior Publication Data

US 2018/0058693 A1 Mar. 1, 2018

(30) Foreign Application Priority Data

Aug. 29, 2016 (TW) ..... 105127734 A

(51) Int. Cl.
*F23Q 11/04* (2006.01)
*F23D 14/38* (2006.01)

(52) U.S. Cl.
CPC ..... *F23Q 11/04* (2013.01); *F23D 14/38* (2013.01); *F23D 2203/00* (2013.01); *F23D 2207/00* (2013.01)

(58) Field of Classification Search
CPC .. F23D 2207/00; F23D 2203/00; F23D 14/38; F23Q 11/04
USPC ..... 431/268, 255, 256, 328, 344
See application file for complete search history.

(56) References Cited

U.S. PATENT DOCUMENTS 4,023,928 A * 5/1977 Haensel ..... A61L 9/03 392/375
4,502,465 A * 3/1985 Yoshinaga ..... A45D 2/36 126/409
4,949,881 A * 8/1990 Watanabe ..... B05C 17/00546 126/401
2010/0279240 A1 11/2010 Lin
2012/0131907 A1* 5/2012 Yoshioka ..... F01N 3/2026 60/276

FOREIGN PATENT DOCUMENTS

CN 2381902 Y 6/2000
EP 0757968 A1 * 2/1997 ..... B01B 1/005
TW 302052 U 4/1997
TW 349355 U 1/1999
TW 582224 U 4/2004
TW 201700928 A 1/2017

* cited by examiner

*Primary Examiner* — Avinash A Savani
*Assistant Examiner* — Rabeeul I Zuberi
(74) *Attorney, Agent, or Firm* — Alan D. Kamrath; Kamrath IP Lawfirm, P.A.

(57) ABSTRACT

A gas heating device includes a main body defining a combustion chamber, a catalyst disposed in the combustion chamber, and an electric thermal device providing electric thermal energy to heat the catalyst and disposed in the combustion chamber and adjacent to a side of the catalyst.

10 Claims, 4 Drawing Sheets

GAS HEATING DEVICE

BACKGROUND OF THE INVENTION

1. Field of the Invention

The present invention relates to a gas heating device.

2. Description of the Related Art

TW Pat. No. 582224 discloses a gas heating device including a gas combustion chamber, a handle, and a gas reservoir in the handle. The gas heating device is a hair curling iron. The gas combustion chamber has a hollow cylindrical shape. The gas reservoir has an outlet port connected to the gas combustion chamber. The gas combustion chamber includes a core. The core has a meshed cylindrical shape. The core has a top defining an opening and a bottom in fluid communication with the outlet port of the gas reservoir. Gas flows from the gas reservoir to the gas combustion chamber and is ignited in the gas combustion chamber by an ignition device to perform a combustion process.

Furthermore, a temperature controlled heating device generally includes a catalyst disposed in a gas combustion chamber. The catalyst has a reaction temperature and contributes to heating the gas in the gas combustion chamber if it is heated to the reaction temperature. Furthermore, the catalyst is heated in an instantaneous high temperature flash burn in the gas combustion chamber and is cooled to room temperature and becomes inactive when the temperature controlled heating device is unused. However, it is not certain that the catalyst successfully reacts after a flash burn every time. Furthermore, the rate of the decay of catalytic activity of the catalyst after repeated use is accelerated. In addition, the conventional ignition device generates an electric arc to ignite gas, but it is more difficult to ignite the gas as the ambient temperature becomes lower, especially when the ambient temperature falls below 10 degrees Celsius.

The present invention is, therefore, intended to obviate or at least alleviate the problems encountered in the prior art.

SUMMARY OF THE INVENTION

According to the present invention, a gas heating device includes a main body defining a combustion chamber, a catalyst disposed in the combustion chamber, and an electric thermal device providing electric thermal energy to heat the catalyst and disposed in the combustion chamber and adjacent to a side of the catalyst.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a gas heating device including a catalyst, which is able to perform a temperature control function.

It is another objective of the present invention to prevent the catalyst from deterioration easily.

It is a further objective of the present invention that the electric thermal device can render the catalyst active at a low ambient temperature.

Other objectives, advantages, and new features of the present invention will become apparent from the following detailed description of the invention when considered in conjunction with the accompanied drawings.

DETAILED DESCRIPTION OF THE INVENTION

Figure 1:
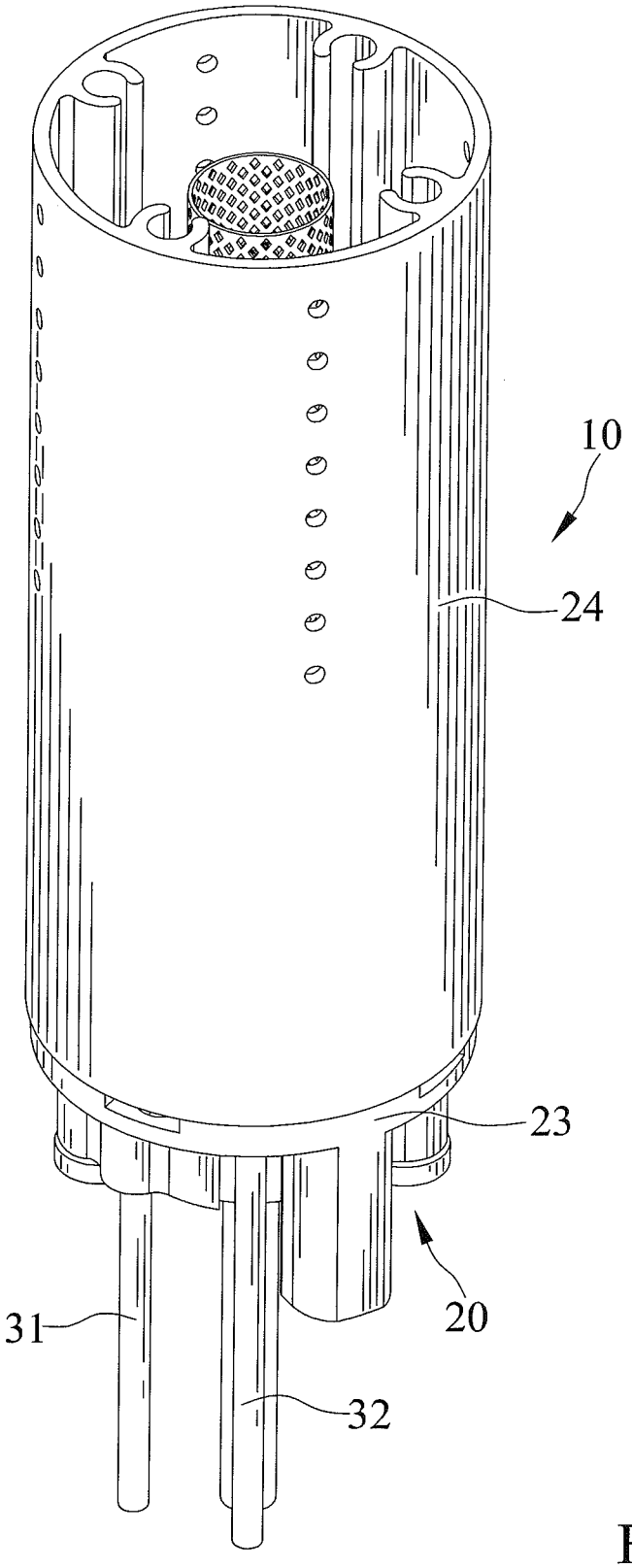
FIG. 1 is a perspective view of a gas heating device in accordance with the present invention.
Figure 2:
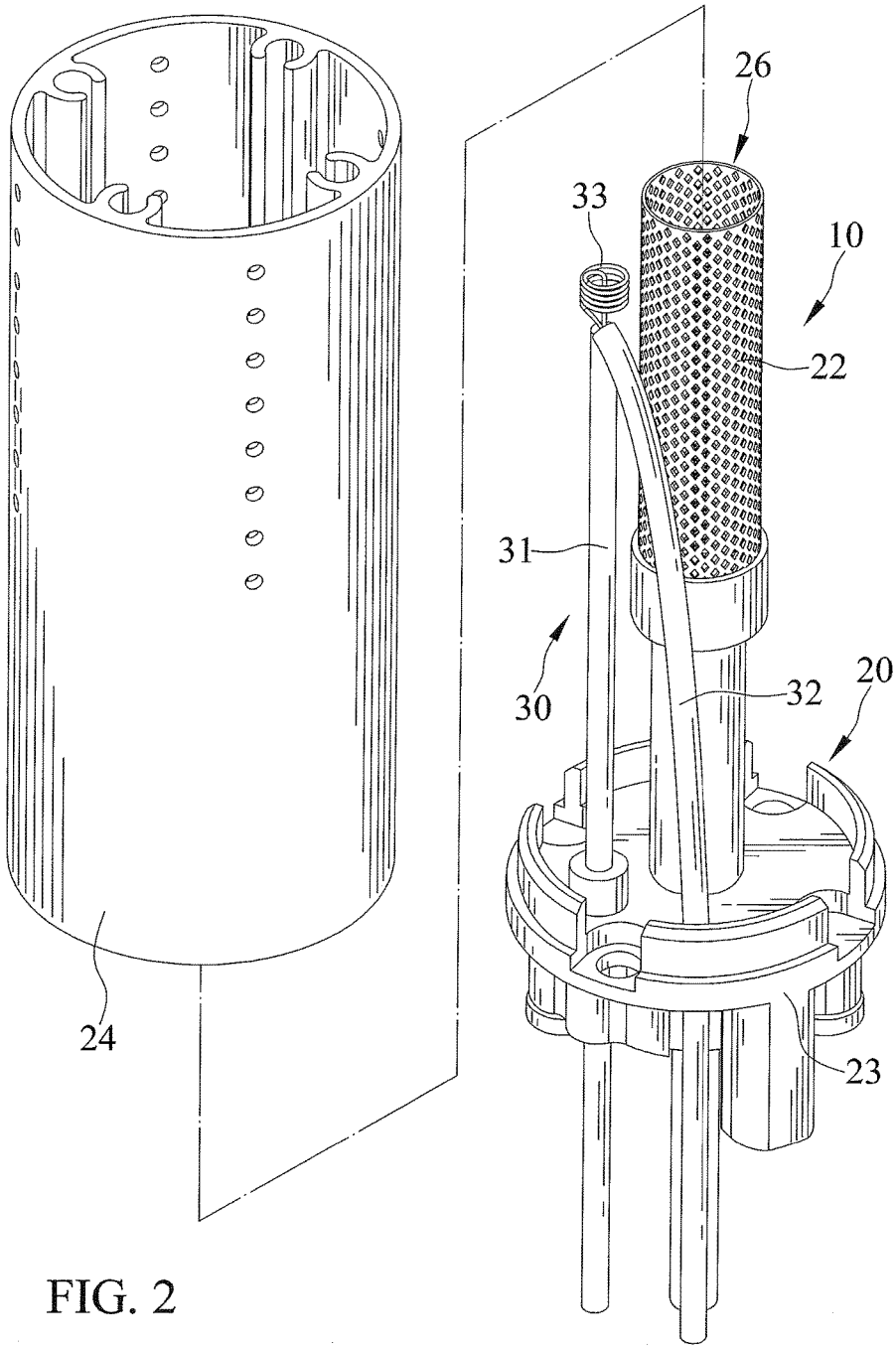
FIG. 2 is an exploded perspective view of the gas heating device of the present invention.
Figure 3:
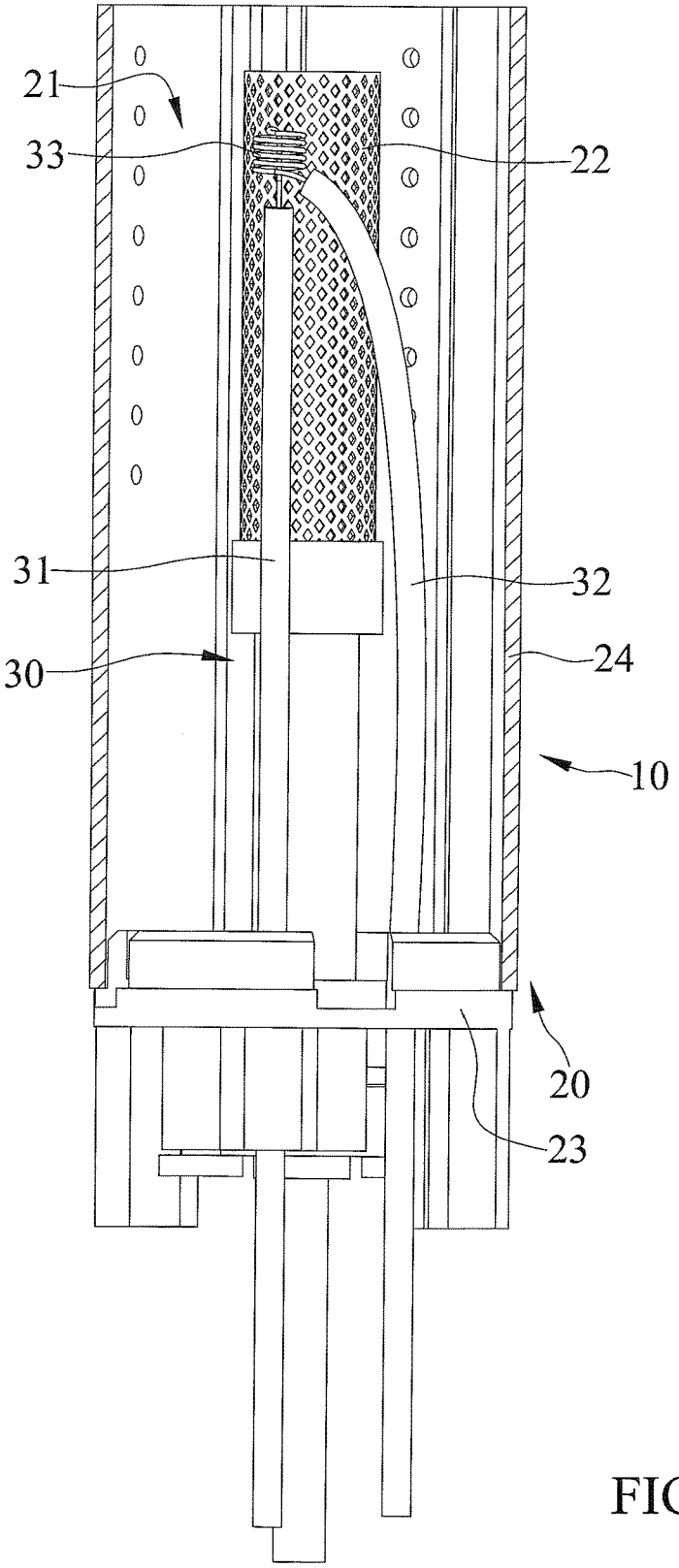
FIG. 3 is a cross-sectional view of the gas heating device of the present invention.
Figure 4:
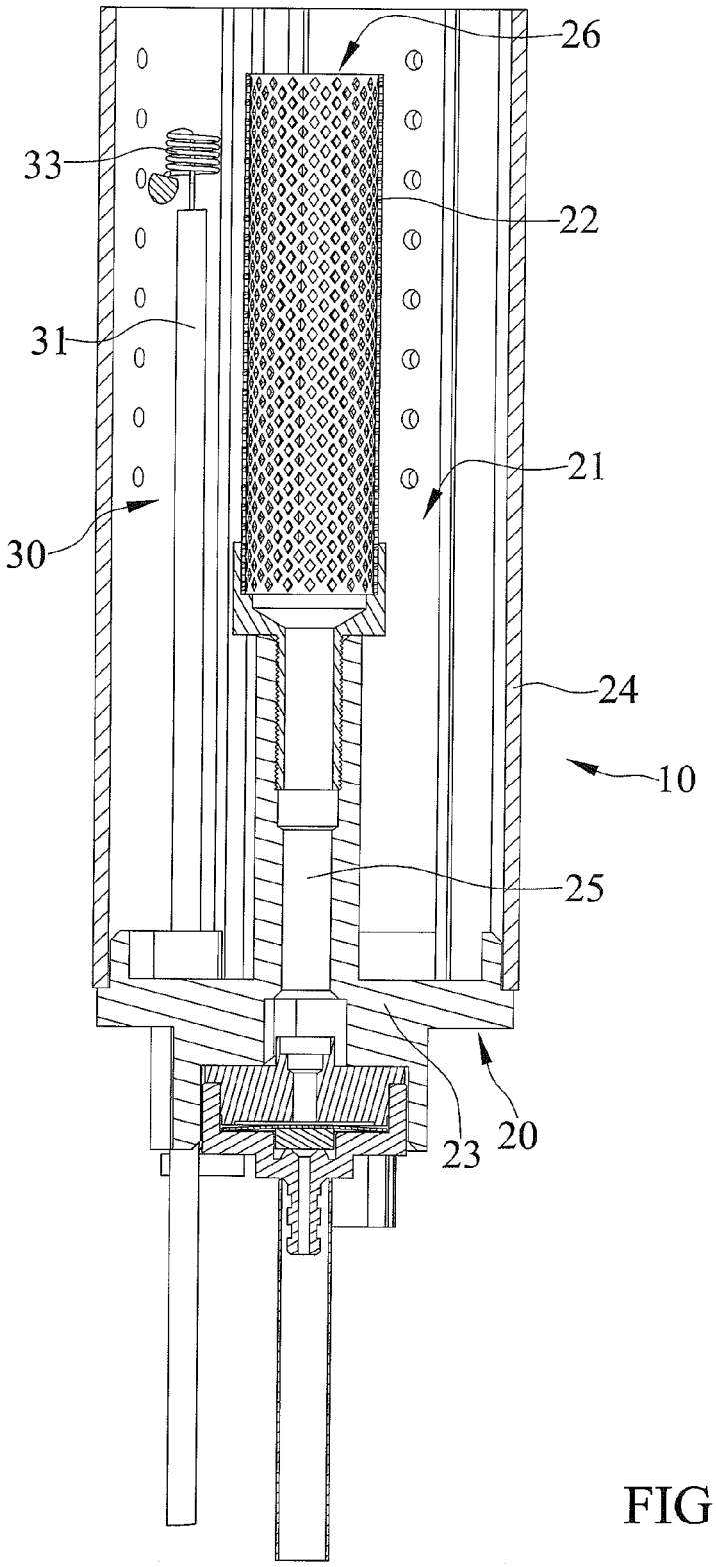
FIG. 4 is another cross-sectional view of the gas heating device of the present invention.

FIGS. 1 through 4 show a gas heating device 10 in accordance with the present invention.

A main body 20 defines a combustion chamber 21, a base 23, and a gas conduit 25 extending through the base 23 and connected to and in fluid communication with the combustion chamber 21.

A catalyst 22 is disposed in the combustion chamber 21. The catalyst 22 is connected to the gas conduit 25. The catalyst 22 includes an end thereof opposing the base 23 and defining an opening 26. The catalyst 22 is meshed and defines a hollow channel. The opening 26 is defined at an end of the hollow channel. The hollow channel is cylindrical. The catalyst 22 includes an outer periphery and defines a plurality of meshes disposed on the outer periphery circumferentially and enclosing the hollow channel. The plurality of meshes is connected to and in fluid communication with the hollow channel and the combustion chamber 21.

An electric thermal device 30 provides electric thermal energy to heat the catalyst 22 and is disposed in the combustion chamber 21 and adjacent to a side of the catalyst 22. The electric thermal device 30 includes a first conducting wire 31 and a second conducting wire 32, and a heating coil 33 includes first and second ends thereof respectively connecting to first ends of the first and second conducting wires 31 and 32. The first ends of the first and second conducting wires 31 and 32 and the heating coil 33 are disposed in the combustion chamber 21. The first and second conducting wires 31 and 32 extend through the base 23, and each have an end disposed outside the combustion chamber 21. The heating coil 33 is disposed outside the outer periphery of the catalyst 22. The heating coil 33 is disposed at a height not taller than a height of the opening 26 of the catalyst 22. The heating coil 33 includes a wire which is looped, which is made of high electrical resistivity material and which is made of metal. The heating coil 33 includes the wire which is looped to form a plurality of loops. The plurality of loops is coaxial to each other.

An outer shell 24 is disposed on the base 23 and encloses the combustion chamber 21 and the catalyst 22. The outer shell 24 includes an end thereof opposing the base 23 and defining an open port. The outer shell 24 includes an outer periphery and defines at least one through orifice disposed on the outer periphery. The though orifices allow outside ambient air to flow in the combustion chamber 21. The outer shell 24 also protects a user of the gas heating device 10 from burns.

The electric thermal device 30 generates heat, which is in a range between 280 degrees Celsius and 500 degrees Celsius. The catalyst 22 is reacted by the heat generated by the electric thermal device 30. Because a side of the catalyst 22 is disposed adjacent to the electric thermal device 30, the heat generated by the electric thermal device 30 can render the catalyst 22 active.

In view of the forgoing, the electric thermal device 30 does not flash burn the catalyst 22. Rather than using a piezoelectric type of ignition device or an ignition device that generates an electric arc, the electric thermal device 30 provides electric thermal energy to heat the catalyst 22. Advantageously, the catalyst 22 is rendered active more easily than conventional ways and includes a longer activity life.

The foregoing is merely illustrative of the principles of this invention and various modifications can be made by those skilled in the art without departing from the scope and spirit of the invention.

What is claimed is:

1. A gas heating device comprising:

a main body defining a combustion chamber, wherein the main body includes a base and a gas conduit carrying a combustible gas and extending through the base and connected to and in fluid communication with the combustion chamber;

a catalyst disposed in the combustion chamber, wherein the catalyst is connected to the gas conduit;

a heating coil providing electric thermal energy to heat the catalyst and disposed in the combustion chamber completely outside of the catalyst and adjacent to a side of the catalyst, wherein the heating coil includes a coil wire which is looped to form a plurality of loops, with the catalyst being of a cylindrical shape, and wherein the plurality of loops is coaxial to each other and is located outside of the cylindrical shape of the catalyst;

a first conducting wire; and a second conducting wire, with the heating coil including first and second ends thereof respectively connecting to first ends of the first and second conducting wires, wherein the first ends of the first and second conducting wires and the heating coil are disposed in the combustion chamber, and wherein the first and second conducting wires extend through the base and each have an end disposed outside the combustion chamber.

2. The gas heating device as claimed in claim 1, wherein the coil wire is made of high electrical resistivity material and is made of metal.

3. The gas heating device as claimed in claim 1, wherein the catalyst includes an end thereof opposing the base and defining an opening, wherein the catalyst is meshed and defines a hollow channel.

4. The gas heating device as claimed in claim 1, wherein the catalyst includes an end thereof opposing the base and defining an opening, wherein the catalyst is meshed and defines a hollow channel.

5. The gas heating device as claimed in claim 4, wherein the hollow channel is cylindrical, and wherein the catalyst includes an outer periphery and defines a plurality of meshes disposed on the outer periphery circumferentially and enclosing the hollow channel, with the gas conduit having a passageway in fluid communication with the hollow channel, with the passageway having a smaller cross section than the hollow channel.

6. The gas heating device as claimed in claim 5, wherein the heating coil is disposed outside the outer periphery of the catalyst and intermediate and spaced from the base and the opening of the catalyst.

7. The gas heating device as claimed in claim 6, wherein the heating coil is disposed at a height not taller than a height of the opening of the catalyst.

8. The gas heating device as claimed in claim 1 further comprising an outer shell disposed on the base and enclosing the combustion chamber and the catalyst.

9. The gas heating device as claimed in claim 8, wherein the outer shell includes an end thereof opposing the base and defining an open port.

10. The gas heating device as claimed in claim 9, wherein the outer shell includes an outer periphery and defines at least one through orifice disposed on the outer periphery.

* * * * *